United States Patent [19]

Murray

[11] Patent Number: 4,871,054

[45] Date of Patent: Oct. 3, 1989

[54] VENDING MACHINE

[75] Inventor: David R. V. Murray, St. Albans, United Kingdom

[73] Assignee: Sankey Vending Limited, West Midlands, United Kingdom

[21] Appl. No.: 236,193

[22] Filed: Aug. 25, 1988

[30] Foreign Application Priority Data

Aug. 28, 1987 [GB] United Kingdom ..... 8720297

[51] Int. Cl.[4] ..... G07F 11/06

[52] U.S. Cl. ..... 194/212; 221/4; 221/6; 221/90

[58] Field of Search ..... 221/2, 3, 6, 12, 14, 221/5, 69, 87, 89, 90; 194/205, 212, 213, 254, 256, 258, 261, 277

[56] References Cited

U.S. PATENT DOCUMENTS 4,519,522 5/1985 McElwee ..... 221/13

FOREIGN PATENT DOCUMENTS 0205691 12/1986 European Pat. Off. ..... 221/69

87/05730 9/1987 World Int. Prop. O. .

*Primary Examiner*—F. J. Bartuska

*Attorney, Agent, or Firm*—Marshall, O'Toole, Gerstein, Murray & Bicknell

[57] ABSTRACT

A machine for renting articles, e.g. video cassettes, which stores individual articles in containers (26) from which they may be rented by the user and wherein an opto-electronic emitter and sensor cobination (55) is provided to sense whether an article is in a container when the latter is in its closed state, a further opto-electronic emitter and sensor combination (56) may be provided to sense whether or not a container is in its closed state, a microprocessor (61) is arranged to permit the container to remain in its closed state if the article is sensed in the container and to re-open the container if it is not so sensed, and when the container is closed a predetermined number of further times without the article being sensed, disabling action is taken.

11 Claims, 8 Drawing Sheets

VENDING MACHINE

BACKGROUND TO THE INVENTION

Field of the Invention

This invention relates to vending machines. The term "vending machine" in the present application is intended to cover machines arranged to rent a re-usable articles, such as a video tape cassette, and accept its return. Additionally such a machine may be arranged to vend such articles.

In such machines it is necessary, for various purposes, to sense whether the containers in which the individual articles are stored are open or closed and whether or not there is an article in any particular container.

Micro-switches have been used for this purpose which are operated by engaging the containers and/or by passing through a hole in the container wall to engage an article therein.

Malfunction of the micro-switches or interference with the micro-switches by a defrauder who is able to operate them from outside the machine could cause loss of articles from the machine.

It is therefore an object of the invention to provide a vending machine in which sensors are provided, primarily to ascertain whether or not an article is in a container but optionally to find out whether a container is in its open or closed state and which cannot be operated in an unauthorised way or which at least are extremely difficult to operate in an unauthorised way.

SUMMARY OF THE INVENTION

According to the invention, therefore, there is provided a vending machine for renting re-usable articles, e.g. video tape cassettes, and comprising means for validating a user input to allow a user to operate the machine; a plurality of containers each adapted for receiving an article and each having a latched closed state in which an article in the container is not available to a machine user and an open state in which an article can be removed from or replaced in the container by the user, each container having associated therewith an opto-electronic sensor and an opto-electronic emitter, each container also having an identifying code and each article having an identifying code and an identifying element arranged to be presented to the emitter and the sensor when the article is in the container and the latter is in its closed state, the identifying element being so located on the article and being such that when subject to the output of the emitter it causes a signal to be generated by the sensor; control means having a rental mode and a return mode; user-operable input means to input a code; the control means being capable of being activated by the user when the control means is in rental mode to open a selected container and being capable of being activated by the inputting of an article code via the input means when the control means is in return mode to open an empty container to receive the article; and a memory associated with the control means and which holds the codes of empty containers and also the code of each article in the machine against the code of the container in which the article is held from time to time, the memory being updated every time an article is rented and every time an article is returned; the control means being arranged to open an empty container when a valid article code is inputted via the input means in the return mode of the control means and to permit the container to be returned to and remain latched in its closed state if the identifying element of an article placed therein is presented, when the container is closed, to the emitter and sensor associated with the container.

By using opto-electronic sensors and emitters it is possible to protect these behind a protective screen and only have apertures in the screen through which the emitter and the sensor can send and receive radiations. If, as is preferred, an infra-red emitter and sensor are used, a defrauder would be unable to see that the sensors were in fact present or operative.

Preferably if after an empty container has been opened by the control means it is returned to its closed state and a cassette identifying element is not presented to the emitter and sensor of the container, the control means acts to reopen the container, means being provided to bring to the attention of the user that an article has not been correctly inserted into the container.

Additionally, if after a first reopening of the container by the control means, the user again closes the container one or more times without an article correctly inserted therein with its identifying element presented to the emitter and sensor of the container, the control means acts to (1) hold the container latched in its closed state, (2) invalidates any input by the user concerned to rent articles and (3) disables the container concerned from being opened by any other user, all until the control means is reset.

Optionally each container also has an identifying element and has associated therewith an opto-electronic sensor and an opto-electronic emitter, the identifying element being so located on the container and being such that, when the container is in its closed state, if the identifying element is subject to the output of the emitter a signal is generated by the sensor whereas if the container is in its open state no such signal is generated.

As has been mentioned above, preferably some at least of the sensors and emitters operate in the infra-red part of the spectrum and therefore their operation is invisible.

In another arrangement, however, a single continuously flashing source may be used, e.g. a xenon tube, which is associated with a plurality of optical fibres, each optical fibre providing an emitter for a container. Thus there could be a bundle of optical fibres with their one ends against the tube and each fibre having a free end which provides the emitter, the free end of the fibres being respectively arranged adjacent to the respective containers. The flashing source may operate in the ultra-violet part of the spectrum and the identifying element be phosphorescent so that it emits light after the emitter has ceased emitting which light can be detected by the sensor. This arrangement makes it difficult for a defrauder to provide false identifying elements.

Preferably, each identifying element is in the form of a tamper-proof label which cannot be removed without destroying its capability of causing a signal to be generated by a sensor when subjected to the output of an emitter.

Other features of the invention will be clear from the following description and claims.

BRIEF DESCRIPTION OF DRAWINGS

An embodiment of the invention will now be described in detail and by way of example with reference to the accompanying drawings in which.

DESCRIPTION OF PREFERRED EMBODIMENTS

Figure 1:
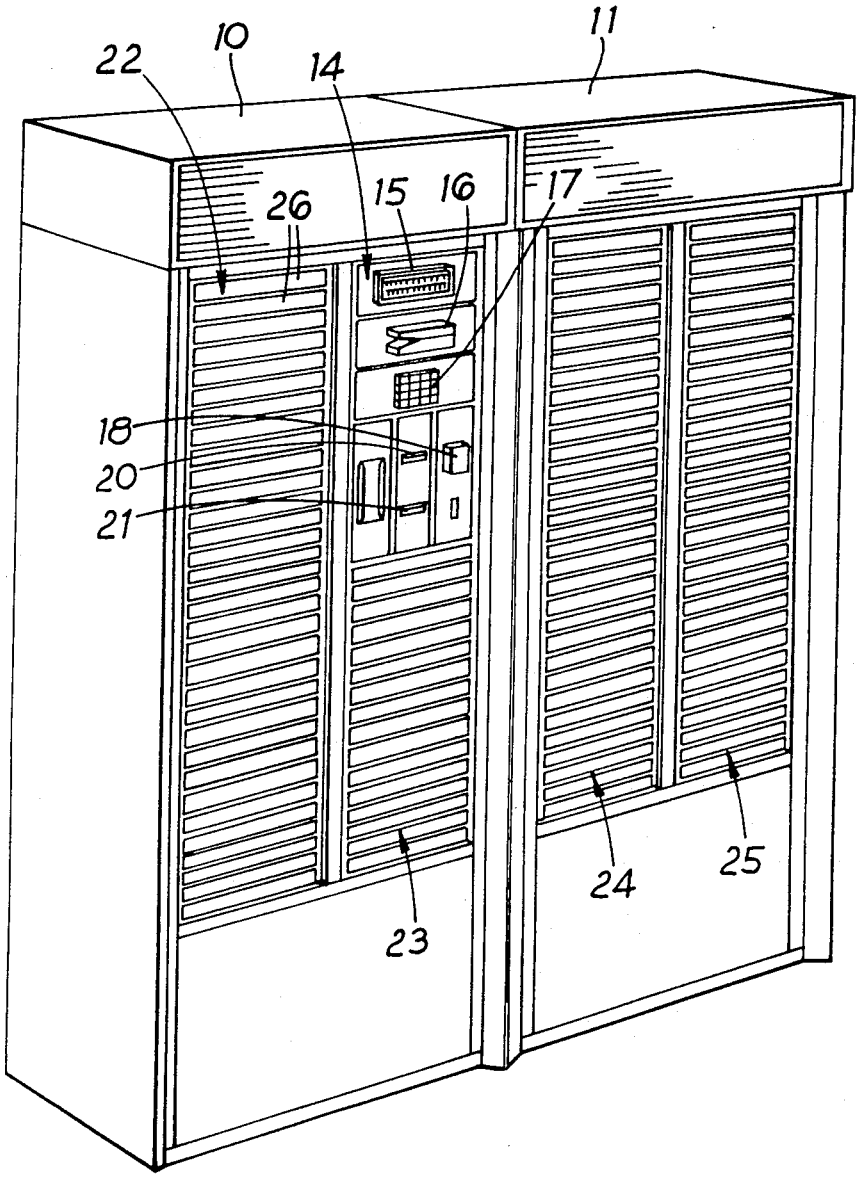
FIG. 1 is a perspective view of a vending machine embodying apparatus of the invention.

Referring now to FIG. 1, the vending machine there shown comprises a master unit 10 and a slave unit 11 which are connected together and are supported if desired by a connection, not shown, to an adjacent wall.

The master unit contains a control panel 14 which in turn contains a display 15, a wipe-through card reader 16, a key pad 17, a coinage receiver 18, a card dispenser 20 for dispensing a club card and a printer outlet 21.

Video tape cassettes are received in columns of containers, there being four such columns of containers indicated generally at 22, 23, 24 and 25. The columns 22 and 23 are in the master unit and the columns 24 and 25 are in the slave unit. The columns are made up of modules of eight containers, each of the columns having four such modules except column 23 which has only two. The control and operation of all the containers is from the control panel 14. Additional slave units having additional columns of containers may be added to the right-hand end of the assembly and controlled from the control panel 14.

Figure 2:
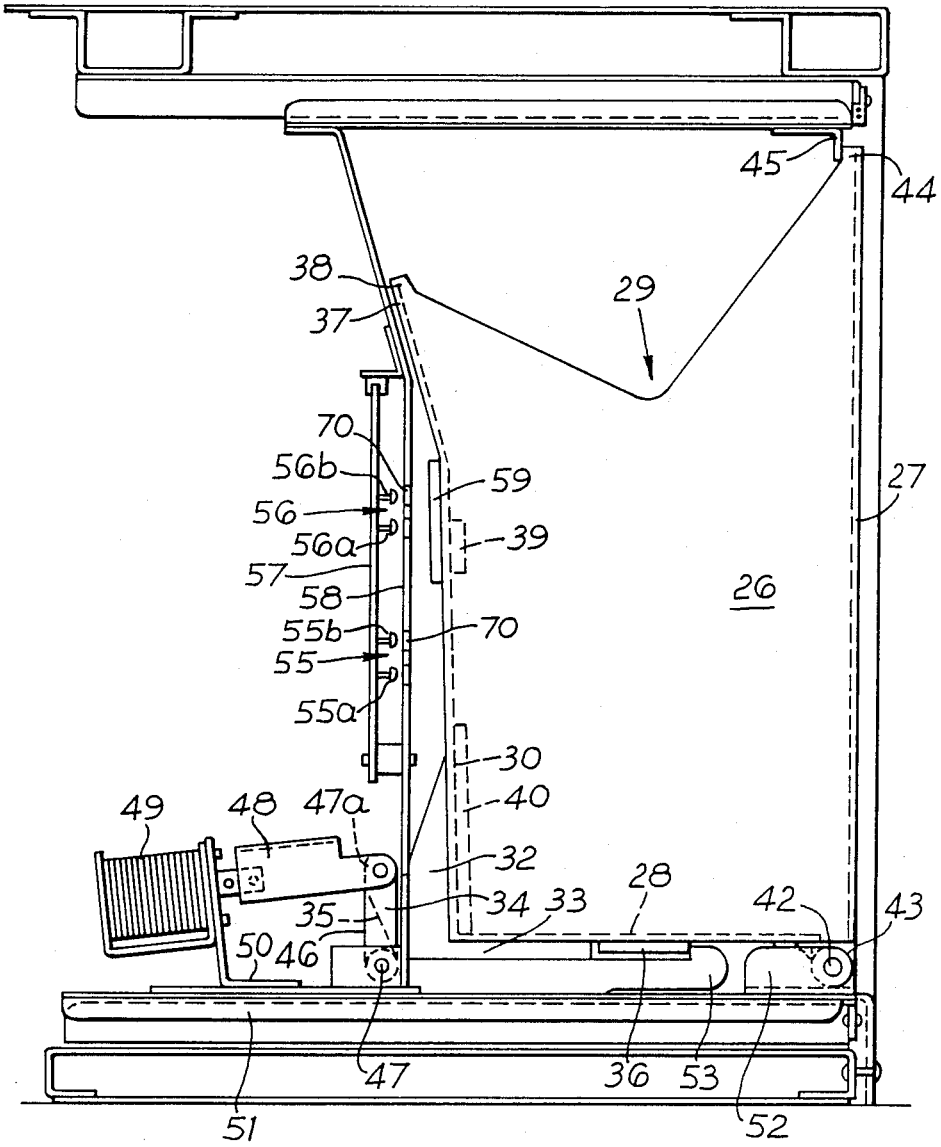
FIG. 2 is a section through one of the containers shown in FIG. 1.

FIG. 2 is a horizontal section through one of the columns 22 to 25 and shows a container 26.

The container 26 is moulded from a high strength transparent plastic material and is in the form of a pocket of generally rectangular cross section. Thus the pocket has a transparent front face 27, a closed end 28 and an open end 29. The container has a transparent back face 30. A projection 32 in the form of a rib extends rearwardly from the back face 30 and is continued at 33 along the closed end 28. The rib has an abutment 34 and an inclinded surface 35. The rib extension 33 on the closed end terminates in a pocket 36. It will be seen that the open end 29 of the container is cut away so that an article received therein may be grasped when the container is open, as will be described, and that the rear face 30 diverges at its upper end, in FIG. 2, as indicated at 37 ending in an abutment 38.

The rear face 30 is formed on its internal surface with pairs of ribs 39 and 40 on either side of the aperture 31 and these ribs provide a groove between them for locating a sleeve containing a tape cassette as described in International Application PCT/GB87/00197 to which reference should be made.

The container 26 is pivoted about an axis which in use is vertical and is indicated at 42, the container being provided with an apertured lug 43 for that purpose. The container in FIG. 2 is shown in a closed state and has an abutment 44 which engages a fixed abutment 45 on the supporting structure of the unit.

The container is held in a closed position by a latch comprising a pair of links 46 which are pivoted at 47 to the supporting structure and, at their upper ends in FIG. 2, are connected by a pin 47*a* which has a roller (not shown) mounted thereon which engages the abutment 34. Also secured to the pin 47*a* is a link 48 which in turn is connected to a solenoid 49. The link 48 is spring urged to the right in FIG. 2 so that the parts normally occupy the positions shown in that Figure. The solenoid is mounted at 50 on the supporting structure 51 which also carries a support 52 for the pivot axis 42.

A U-shaped spring 53 has one end received in the pocket 36 and the other end engages the structure 51. The arrangement is such that if the solenoid 49 is energised it pivots the links 46 in an anit-clockwise direction in FIG. 2, the roller on the pin 47*a* comes out of engagement with the abutment 34 and the container is moved by the spring 53 to an open position in which the abutment 38 is midway between the position shown in FIG. 2 and the abutment 45. The customer may then open the container against the spring 53 until the abutment 38 engages the abutment 45. Release of the container results in the spring returning it to its midway position and then it may be closed by the customer. In the fully open position an article in the container can be removed or replaced.

The container is shut manually and as it is moved to its closed position the surface 35 engages the roller on the pin 47*a* and retracts the link 48 until the container reaches its fully closed position whereupon the link 48 moves to the right in FIG. 2 and the roller on the pin 47*a* again engages the abutment 34 to hold the container in a closed position.

Associated with each container 26 there are two sensing means, namely 55 and 56. Each sensing means comprising an electro optical emitter 55*a* and 56*a* and an electro optical sensor 55*b* and 56*b*. The sensing means 55 and 56 are mounted on a printed circuit board 57 which runs the whole length of a module of eight containers 26 and carries all the emitters and sensors and associated circuitry for the containers 26 in that module. In front of the printed circuit board 57 is a back plate or screen 58 positioned between each container 26 and its associated opto-electronic sensors 55*b* and 56*b* and opto-electronic emitters 55*a* and 56*a*. The screen 58 has apertures 70 therein arranged to allow radiation to pass from each emitter 55*a* and 56*a* to the container 26 and from the container 26 to the sensors 55*b* and 56*b*. The sensing means 55 may be used to sense whether there is a cassette in the container 26 when it is in a closed state and the sensing means 56 may be used to sense whether or not the container 26 is in its closed state.

The emitters 55*a* and 56*a* are arranged to emit light radiation and are provided by light-emitting diodes. The sensors 55*b* and 56*b* are arranged to detect light levels above a given threshold and are provided by photo-electric cells. However, any other suitable form of radition emitters and sensors may be used, e.g. emitters and sensors operable in the infra-red band of the spectrum. The angles at which the emitters 55*a* and 56*a* and the sensors 55*b* and 56*b* are mounted on the printed circuit board 57 are adjustable and are adjusted when the printed circuit board 57 is installed to ensure that the radiation emitted by each emitter follows the intended path and is received by the associated sensor.

Thus referring first to the sensing means 56, the container is provided, at a position opposite to the sensing means, with a reflective label 59. The arrangement is such that when the container is in its closed position as shown in FIG. 2, if radiation is emitted from the emitter 56*a* of the sensing means 56 it will be reflected from the label 59 and will result in a signal being generated by the sensor 56*b* of the sensing means 56. If, however, the container 26 is in its open position there wil be insufficient reflection from the label to cause a signal to be generated in the sensor of the sensing means 56.

If the emitter is pulsed regularly at short time intervals it is thus possible to ascertain at said short time intervals whether the container 26 is in its open or closed position depending on whether or not signals are generated in the sensor 56*b* of the sensing means 56 by radiation emitted from the emitter of the sensing means.

In one possible embodiment, a tube which continually flashes (not shown), for example a xenon tube, can be used to provide emitters for a number of containers by transmitting, through optical fibres, the flashes from the xeron tube to an appropriate position on the printed circuit board 57 to cooperate with a sensor mounted thereon. Thus one would have a bunch of fibres receiving flashes from the tube continually and passing down the optical fibres to the free ends thereof, each free end providing an emitter associated with a container. As mentioned above, the tube may emit ultra-violet radiation to phosphorescent elements whose light is detected.

As described in the above mentioned PCT application, it is intended that the cassette will fit into a sleeve which in turn fits into the container 26, the sleeve having a rib to engage between the ribs of the pairs of ribs 39 and 40 so as to ensure that the sleeve is inserted in the correct position. The sleeve is made of a transparent plastic material.

The cassette is also provided with a label (not shown) similar to the label 59 and it is arranged that when the cassette within its sleeve is properly located in the container 26 radiation from the emitter 55*a* of the sensing means 55 will be reflected by the label to produce a signal in the sensor 55*b* of the sensing means thus enabling the latter to be used, when the container is in its closed state, to sense whether there is a cassette in the container which bears an appropriate reflective label.

Preferably the label 59 and the label on the cassette are tamper-proof labels. That is to say that they cannot be removed from the container and the cassette respectively without destroying their reflective properties which would thus prevent the sensors operating correctly. Thus if somebody tried to remove the reflective label from a cassette which he had had from the machine and put it on another item of the same size this would be impossible and, as described below, if, upon a cassette being returned, the sensing means 55 does not sense an appropriate reflective label the cassette will be rejectd or, if repeated efforts are made to return it, it will be accepted but the container will be disabled and the user will be prevented from carrying out any further transactions until the machine has been reset.

The reflective label on the cassette is "visible" to the sensor of the sensing means 55 through the transparent back wall 30 of the container and through the transparent sleeve in which the cassette is received within the container.

If, after a container has been opened, it is not shut by the user of the machine, this will be sensed by the sensing means 56 which will disable the machine until the container has been shut.

The machine is designed to dispense video tape cassettes and it is important to the operation of the machine when used with such cassettes, that the name on the cassette can be read through the transparent front face 27 of the container. It is therefore important that the cassette be placed in the container in an appropriate position. This is facilitated by the provision of the sensing means 55 since for the reflective label to cause generation of a signal in the sensor of the sensing means 55 the label must face the sensing means and the label will be arranged so that when this happens the title of the cassette can be read through the front wall 27 of the container 26.

Figure 3:
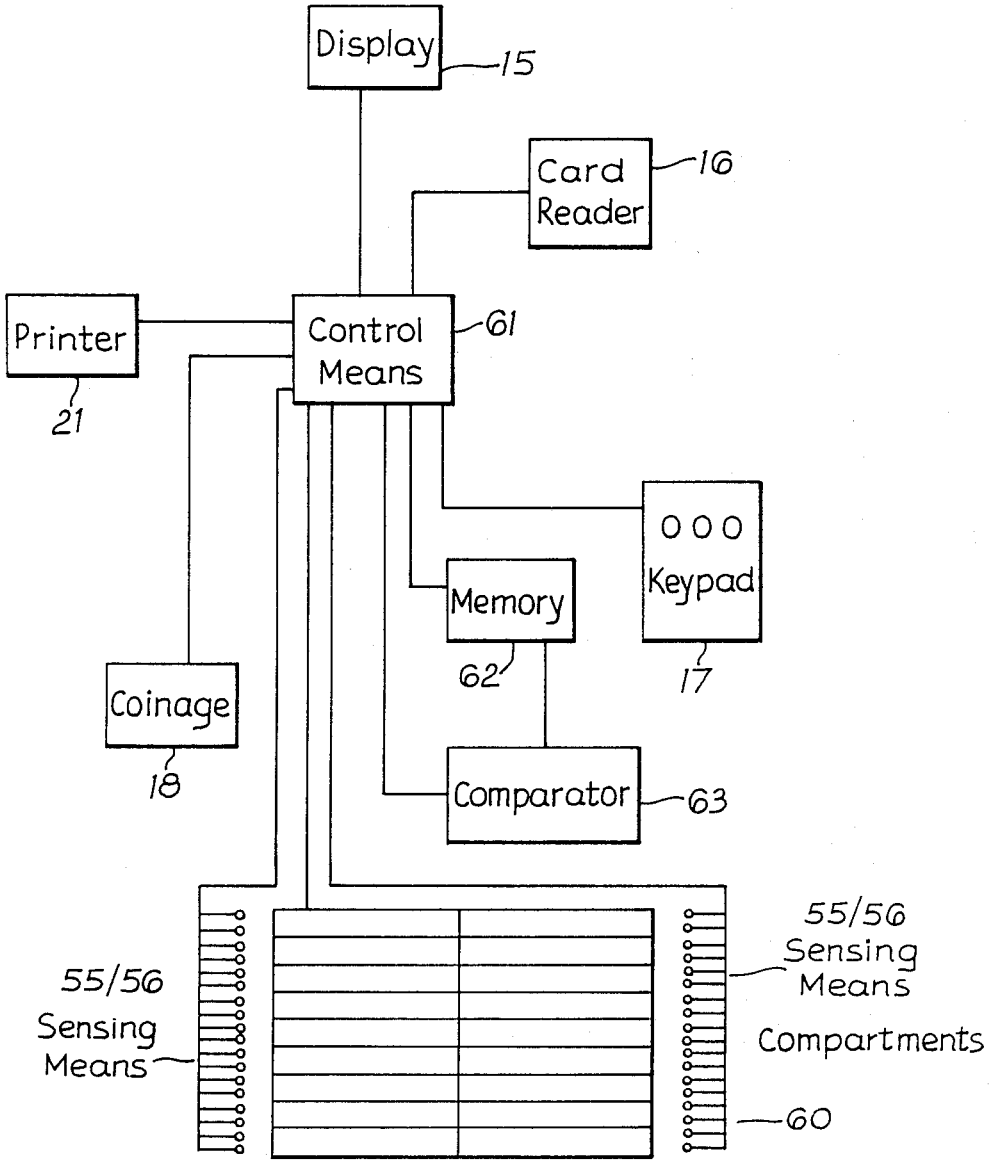
FIG. 3 is a schematic block diagram of the vending machine.

Referring now to FIG. 3, one of the groups of containers in the machine is indicated in this figure at 60 and is controlled by control means in the form of a microprocessor indicated schematically at 61. The control means is connected to the display 15, the card reader 16, the key pad 17 and the coinage mechanism 18 which are all of conventional construction.

The printer 21 is connected to the control means 61 as is a memory 62. A comparator 63 is connected to the control means 61 and the memory 62.

Preferably, the machine is arranged to be operated by a club card. Thus a user may purchase a club card for a given sum and this will entitle him to a certain number of rentals or he may be allowed a number of rentals on credit.

The sequence of operation of the machine is, referring to FIGS. 4 to 8, as follows.

Figure 4:
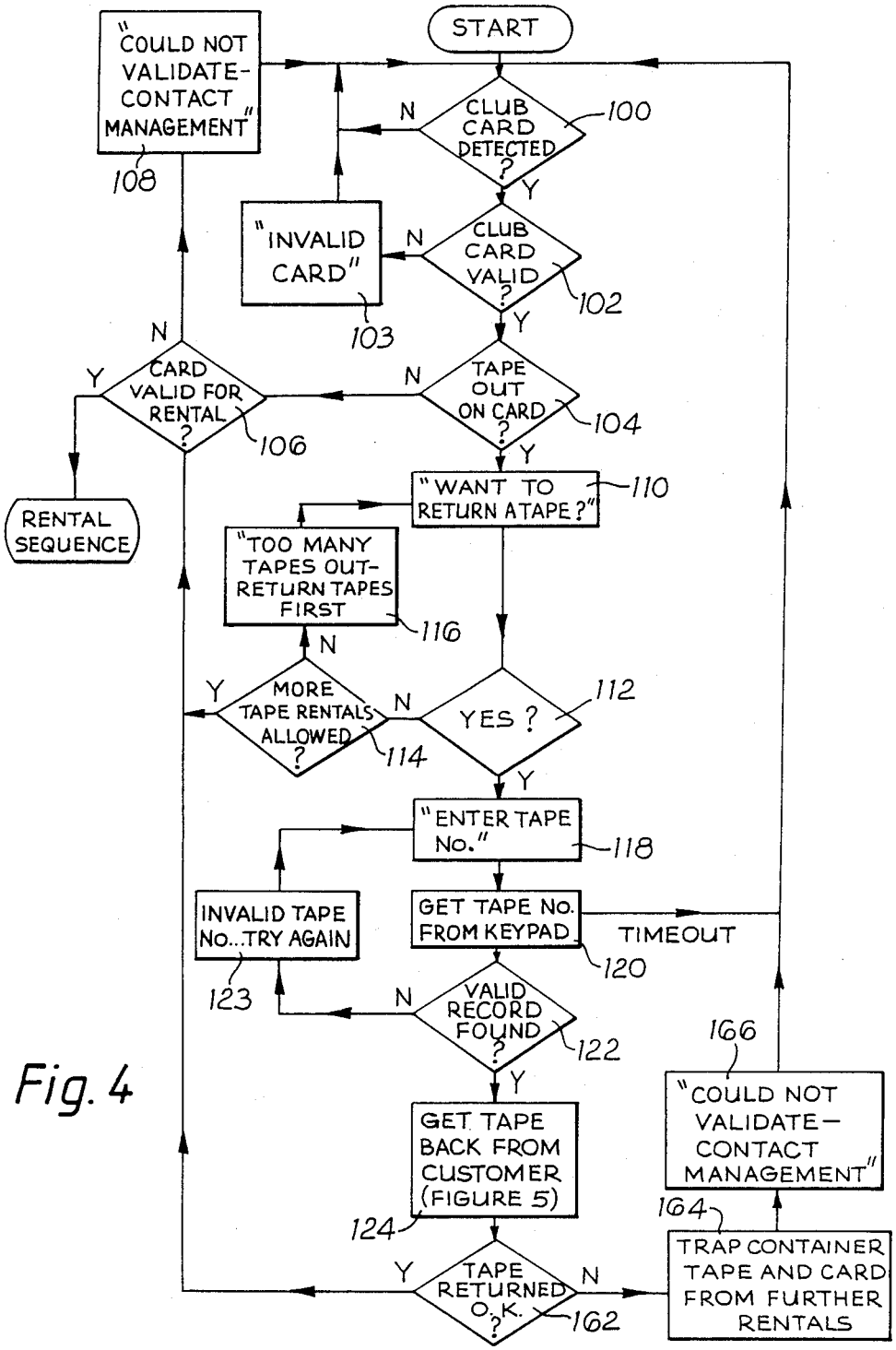
FIGS. 4 to 8 are simplified flow charts of the operation of control means of the machine, FIG. 6 being a continuation of FIG. 5.
Figure 5:
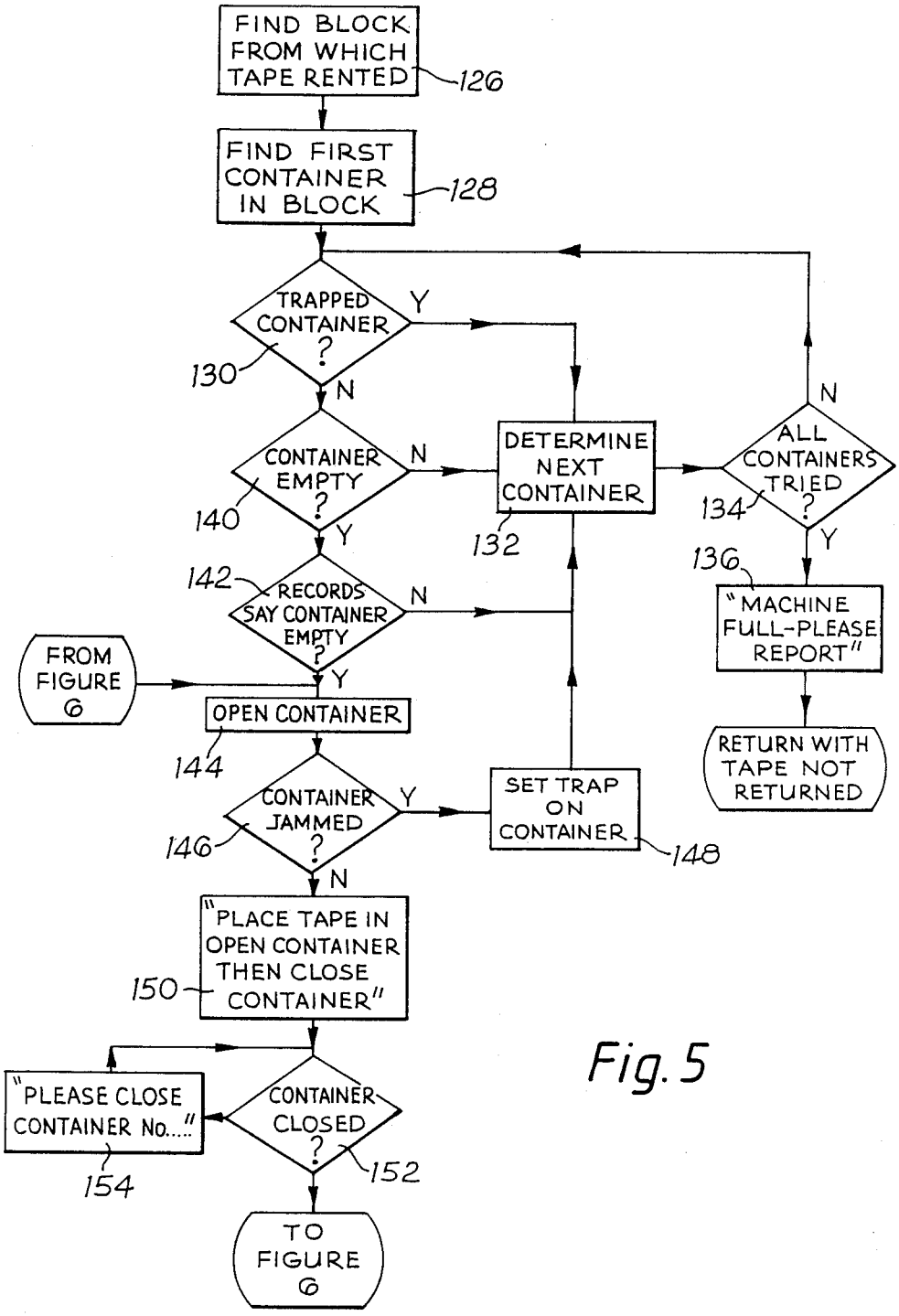

FIG. 4 shows the sequence carried out by the control means 61. At step 100, a club card is detected or, if not, the sequence returns to the start. Once a card has been detected by a user passing it through the reader 16 and the coded user identification on the card read, the control means 61 in step 102 interrogates the memory 62 to ascertain whether the code number read from the card is identical to the code number of a card issued for the machine. This and other comparisons referred to below are made using the camparator 63 to compare the contents of the memory 62 with the data received by the control means 61. If so, the card is regarded as valid. If not, the control means 61 causes the display 15 to display "Invalid Card" at step 103 and returns to the start of the sequence. Normally a club card will only be useable on one machine unless the machines are interlinked. The first time a particular club card is used it will establish a credit stored in the memory 62.

If the card detected is valid, the control means 61 interrogates the memory 62, in step 104, to ascertain whether the card has been used to rent a tape which has not yet been returned. If not, the control means 61 interrogates the memory 62 to ascertain whether the card is valid for a further rental (step 106). This involves checking the credit level associated with the card to ascertain whether sufficient credit remains to rent a tape. If so, the control means 61 enters the rental mode thereof shown in FIGS. 7 and 8. If not, the control means 61 causes, at step 108, the display 15 to display "Could not validate, contact management" and returns to the start of the sequence.

If the card is found in step 104 to have been used to rent a tape which has not yet been returned, the control means 61 enters its return mode and causes, in step 110, the display 15 to display "Want to return a tape?" and awaits a response from the keypad 17 at step 112. If the response is "No", the control means 61 proceeds to step 114 where it interrogates the memory 62 to ascertain whether any further rentals are allowed. This involves the situation in which two or more simultaneous rentals are allowed on one card and ascertaining whether the maximum permitted number of simultaneous rentals has already been reached for the present card. If no more rentals are permitted before return of a tape, the control means 61 proceeds to step 116 at which the display 15 is caused to display "Too many tapes out—Return tapes first". The control means 61 then returns to step 110.

If the response from the keypad 17 at step 112 is "Yes", the control means 61 proceeds to step 118 at which it causes the display 15 to display "Enter tape No." and at step 120 awaits a response from the keypad 17. If no response is received from the keypad 17 in a predetermined time, the control means returns to the start of the sequence. If a response is received from the keypad 17 within the predetermined time, the control means 61 proceeds to step 122 at which it interrogates the memory 62 to ascertain whether the response received from the keypad 17 represents a valid tape number. In the memory 62, the number of each tape which has been rented and not yet returned is stored against the number of the card used to rent it. At step 122, the number entered via the keypad 17 is compared with the list of tapes out on rental. If a corresponding number is not found, the control means 61 proceeds to step 123. If, however, a corresponding number is found, the card number used to rent that tape is compared with the card number read at step 100. If the card numbers are not identical, the control means 61 proceeds to step 123 but, if they are identical, proceeds to step 124. At step 123, the the display 15 is caused to display "Invalid tape No.—try again" and after a predetermined time returns to step 118. If the tape number is valid, the control means 61 proceeds from step 122 to step 124 which represents the tape return sequence shown in FIG. 5.

The tape return sequence begins at step 126 where the control means 61 interrogates the memory 62 to ascertain which block of eight containers 26 contains the container 26 from which the tape was rented. The control means 61 then proceeds at step 128 to investigate the first container 26 in the block identified at step 126. Firstly, at step 130, the control means 61 investigates whether the container 26 is trapped, i.e. whether a fault or irregularity associated with this container has previously been detected causing a trap to be entered in the memory 62 against this container. If the container 26 is detected as trapped, the control means 61 proceeds to step 132 where it determines the number of the next container in the block or the next block if it has reached the end of a block. The control means 61 then proceeds to step 134 where it determines whether it has applied steps 130 and 132 to all the containers 26 in the machine. This is done by comparing the number determined as a resut of the step 132 with the number determined as a result of step 128. If steps 130 and 132 have been applied to all the containers 26 in the machine, the control means 61 causes at step 136, the display 15 to display "Machine full—please report" and then proceeds to step 162 (to be described) with the message "tape not returned". If, at step 134, it is found that all containers 26 have not yet been tried, the control means 61 returns to step 130.

If, at step 130, it is ascertained that the container 26 is not trapped, the control means 61 proceeds to step 140 where it operates the sensing means 55 associated with the container 26 under consideration to determine whether the container contains a cassette. If the container 26 is found to contain a cassette, the control means 61 proceeds to step 132. If, however, the sensing means 55 fails to detect a cassette indicating that the container 26 is empty, the control means 61 proceeds to step 142. At step 142, the control means 61 interrogates the memory 62 to ascertain whether the container 26 under consideration is empty according to the record of previous transactions stored in the memory. If the container is not ascertained to be empty, the control means 61 proceeds to step 132 and, if it is ascertained to be empty, the control means 61 proceeds to step 144 in which it causes the solenoid 49 of the container 26 under consideration to operate to open the container.

The control means 61 then proceeds to step 146 at which it operates the sensing means 56 associated with the container under consideration to determine whether the container has in fact opened. If the container 26 is detected as still closed by the sensing means 55, the control means 61 causes, at step 148, a trap to be entered into the memory 62 with reference to the container under consideration (such a trap might be used in step 130 aforementioned) and proceeds to step 132. If, however, the sensing means 55 at step 146, senses that the container 26 has opened, the control means 61 proceeds to step 150 at which it causes the display 15 to display "Place tape in open container—then close container" and proceeds to step 152.

Figure 6:
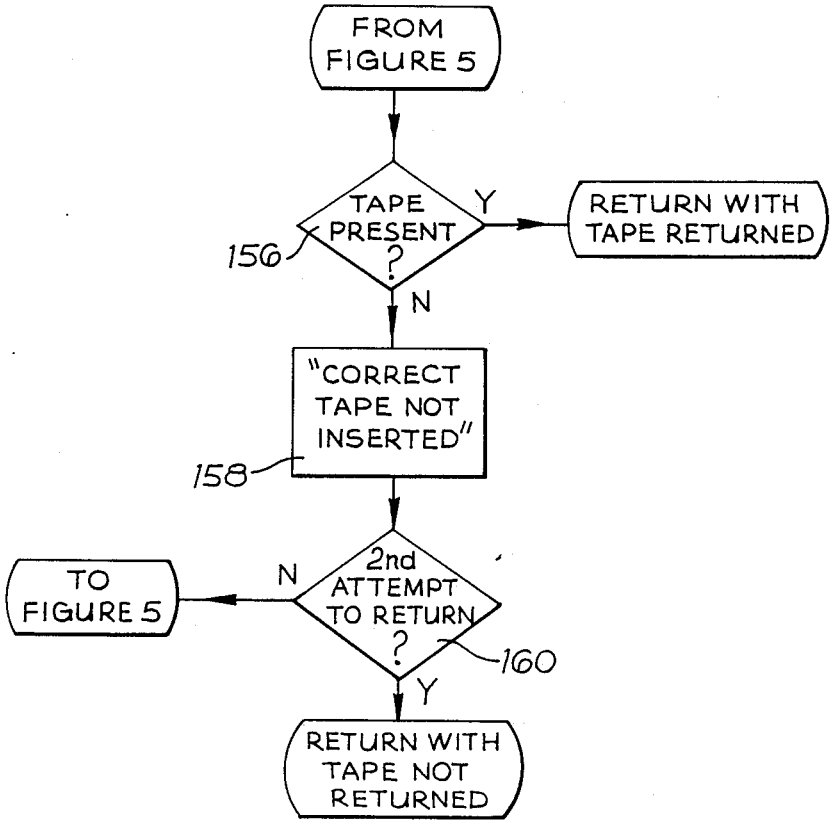

At step 152 after a predetermined time, the control means 61 causes the sensing means 56 to operate to sense whether the container has been closed. If not, the control means proceeds to step 154 at which it causes the display 15 to display "Please close Container No. . . . " and the number of the container 26 under consideration, and then returns to step 152. If the sensing means 56 detects that the container 26 has been closed at step 152, the control means 61 proceeds to step 156 (FIG. 6).

At step 156, the control means 61 operates the sensing means 55 to determine whether there is a tape in the container 26 which has just been closed. If the sensing means 55 does not sense that there is a tape in the container, the control means proceeds to step 158 at which it causes the display 15 to display "Correct tape not inserted". It then proceeds to step 160 at which it checks whether this is the second attempt to return the tape. If it is not the second attempt, the control means returns to step 144 but, if it is the second attempt, it proceeds to step 162 (FIG. 4) with the message "tape not returned". If, however, the sensing means 55 determines at step 156 that a tape is in the container, the control means proceeds to step 162 with the message "Tape returned O.K.".

At step 162 (FIG. 4), the control means 61 checks whether the aforementioned message indicates that the tape has been returned, if not the control means proceeds successively to steps 164 and 166 and then proceeds to the start of the sequence. At the step 164, the control means causes a trap to be entered in the memory 62 in respect of the container under consideration, the tape number under consideration and the card in use. This will cause step 102 to result in the card not being ascertained as valid if it is re-entered into the machine, step 122 determining the tape number as invalid, and step 130 regarding the container as trapped. Step 166 causes the display 15 to display "Could not validate, contact management".

If, at step 162, the message indicates that a tape has been returned, the control means 61 proceeds to step 106 at which it checks card validity before either entering the rental mode or returning to the start via step 108.

If the control means 61 enters the rental mode from step 106, the control means will ask the user which tape he wishes to rent. The user then uses the keypad 17 to enter the number of the container 26 containing the tape concerned and the control means after checking that the container contains a tape and is not trapped will cause the display 15 to display how much the cassette rental costs and ask if this is acceptable. If the user replies "Yes" by appropriate operation of the key pad 17 then the control means will operate to open the appropriate container from which the user will take the cassette. After the user has taken the cassette he should close the container. The sensing means 56 will sense whether or not the container has been closed. If it has not the control means will produce an audible signal and the machine will be disabled until the container is closed.

The control means 61 and the memory 62 will operate so as to decrease in the memory the user credit held by that user by the amount of the rental charge for the cassette.

The memory will also record (1) the block of containers from which each rented cassette was removed, (2) the code of each cassette in the machine against the code of the container in which the cassette is held from time to time, the memory being updated every time a cassette is rented or returned and (3) the code of each cassette which has been rented against the user's identification code.

If the machine is fitted with a printer 21 as indicated then the printer will print out a receipt showing the amount which the user has been debited.

Figure 7:
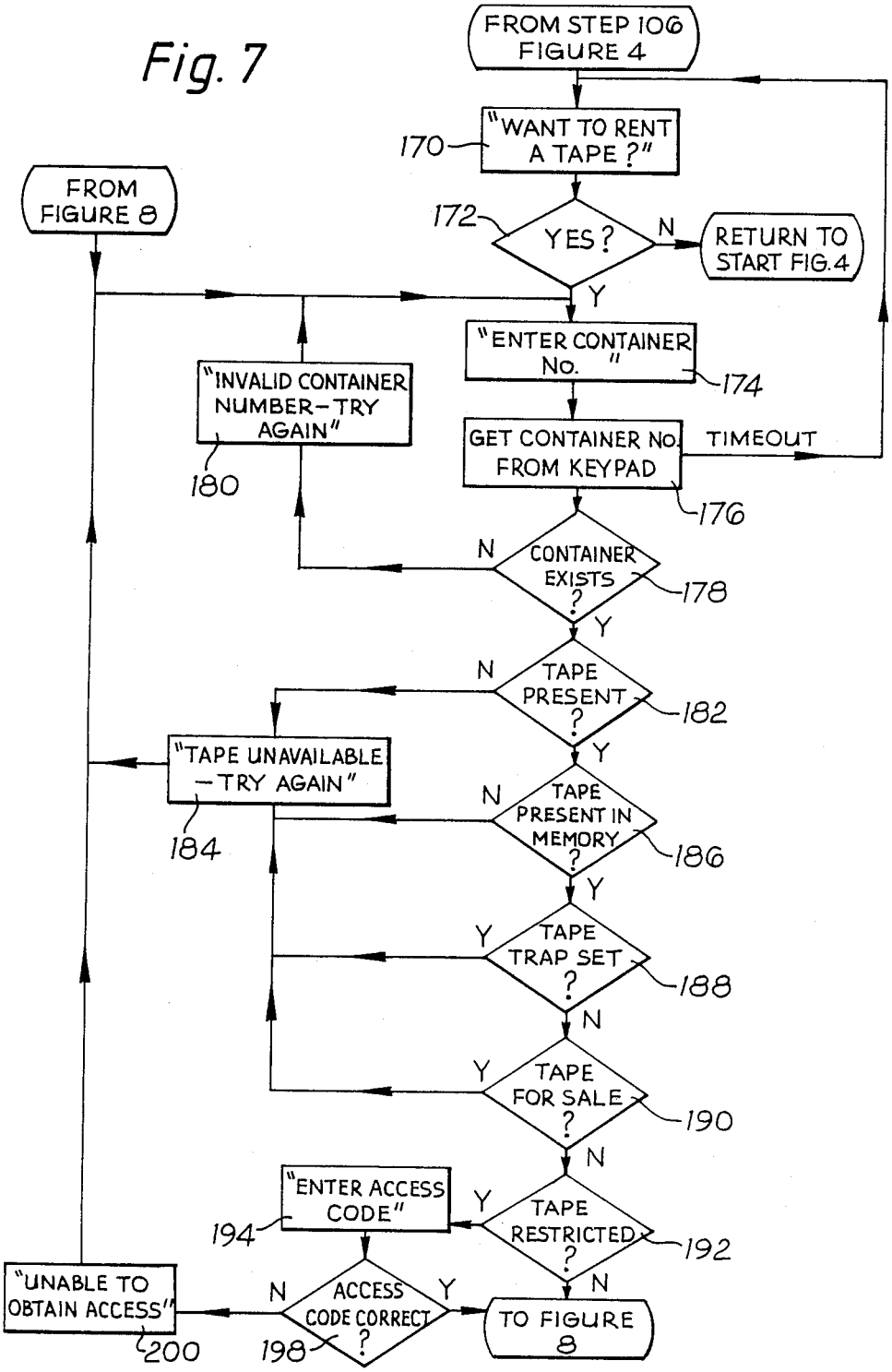
Figure 8:
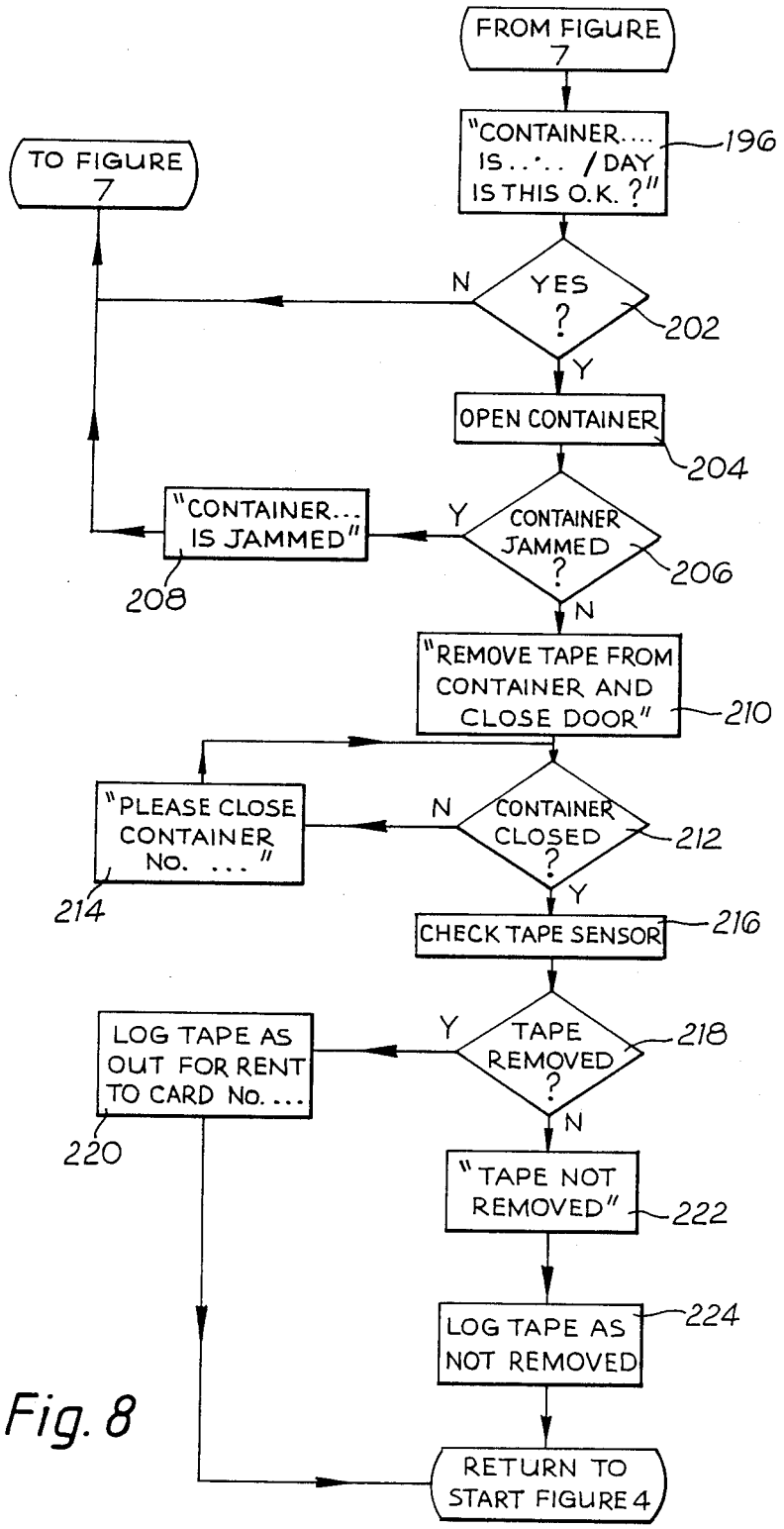

The rental sequence which is entered from step 106 is shown in FIGS. 7 and 8. At step 170, the control means 61 causes the display 15 to display "Want to rent a tape?" and awaits an answer from the key pad 17. If the answer is "No" (step 172), the control means returns to the start of its sequence shown in FIG. 4. If, however, the answer at step 172 is "Yes", the control means proceeds to step 174 at which it causes the display 15 to display "Enter container No.". At step 176, the control means awaits a container number from the key pad 17 and if none is received within a predetermined time returns to step 170. When a container number is received at step 176, the control means interrogates the memory 62 to determine whether the container exists, i.e. whether the number entered into the key pad corresponds to the number of a container allocated to the machine. If the container does not exist, the control means proceeds to step 180 at which it causes the display 15 to display "Invalid container No.—try again" and then proceeds to step 174.

If the container number is found to exist at step 178, the control means 61 causes the sensor 55 to be operated (step 182) to determine whether a tape is present in the container having the number entered at step 176. If a tape is not detected by the sensor 55, the control means proceeds to step 184 at which it causes the display 15 to display "Tape unavailable—try again" and then returns to step 174. If, however, the operation of the sensor 55 in step 182 results in the detection of a tape in the container, the control means proceeds to step 186 at which it interrogates the memory 62 to determine whether according to the contents of the memory a tape should be present in the container. If a tape should not be present, the control means proceeds to steps 184 and 174 successively. If step 186 results in the conclusion that a tape should be present, the control means proceeds to step 188 at which it interrogates the memory 62 to determine whether a trap is set in relation to the tape in question. Such a trap might have been set as a result of an irregularity in previous dealings with the tape in question. If a trap is found to be set at step 188, the control means proceeds to steps 184 and 174 successively. If no trap is found to be set, the control means proceeds to step 190 at which it interrogates the memory 62 to determine whether the tape in question is recorded as for sale rather than for rental. If the tape is found to be recorded for sale, the control means proceeds to steps 184 and 174 successively. However, if the tape is found not to be recorded for sale, the control means proceeds to step 192 at which it interrogates the memory to determine whether the tape is restricted. A tape might be restricted for example if it were only for adult viewing. If a tape is restricted it is necessary to enter an access code in step 194 to obtain rental of the tape. It is, thus, possible to prevent unauthorised access to restricted tapes by allocating a confidential access code to a card sold to an adult so that the adult may obtain access to the restricted tape but a juvenile may not use the card to obtain access to the restricted tape unless he is also in possession of the access code. If the tape is not restricted, the control means proceeds to step 196 (FIG. 8). If, however, the tape is restricted, after proceeding to step 194, the control means 61 proceeds to step 198 at which it checks whether the access code entered from the key pad 17 is correct. If the access code is not correct the control means proceeds to step 200 at which it causes the display 15 to display "Unable to obtain access" and proceeds to step 174. If, however, the access code is correct, the control means proceeds to step 196.

At step 196, the control means causes the display 15 to display "Container . . . is . . . /day is this O.K.?" (where the first gap is filled by the container number and the second gap by an amount of money) and at step 202 awaits a response from the key pad 17. If the response is "No", the control means proceeds to step 174. If, however, the response is "Yes", the control means operates the solenoid 49 associated with the container 26 in question so that the container opens (step 204). Next the control means 61 proceeds to the step 206 at which it operates the sensor 56 to determine whether the container 26 in question has opened. If the container is detected as not having opened, the control means proceeds to step 208 at which it causes the display 15 to display "Container . . . is jammed" and then proceeds to step 174. If, however, the container is detected as having opened, the control means proceeds to step 210 at which it causes the display 15 to display "Remove tape from container and close door". The control means next proceeds to step 212 at which it operates the sensor 56 to determine whether the container has been closed. If not, the control means at step 214 causes the display 15 to display "Please close container no. . . . " and returns to step 212. If the container has been closed, the control means proceeds to step 216 at which it operates the sensor 55 to determine whether there is a tape in the container in question. If, at step 218, it is determined that the tape has been removed, the control means proceeds to step 220 at which it logs the tape in the memory 62 as being out for rent to the card number which was detected at step 100 and returns to the start of the sequence shown in FIG. 4. If, however, the step 218 results in the discovery that the tape has not been removed, the control means proceeds to step 222 at which it causes the display 15 to display "Tape not removed" and then proceeds to step 224 at which it records the tape as not having been removed in the memory and proceeds to the start of the sequence.

The fact that the machine ensures that a cassette cannot be returned by a user using a card other than the one which he used to rent the cassette with ensures that the proper rental charge will be debited against the user's card for the period of rental.

it will be appreciated that if it were possible for the user to use a different card to gain access to the machine to return the cassette then, so far as the machine is concerned, the cassette would never have been returned and the credit of the initially used card would be decreased by, for example, the cost of the cassette.

When the user closes the container at the end of the return sequence, the latch comprising the solenoid 49 and the links 46 and 48 will hold the container in its closed position as described above. In this position, if the cassette has been properly inserted into the container and if the cassette carries an appropriate reflective label, this will be sensed by the sensing means 55 and the signal generated by the sensor of the sensing means will allow the transaction to be completed and the container will remain latched in its closed state.

It is envisaged that the machine will be inspected at regular intervals by a supervisor who will ascertain what has occurred. From what is held in the memory, which may be down-loaded into a data base, the supervisor will be able to see which user it was who returned the incorrect article or returned it the wrong way and if necessary the account of that user can be debited with the total cost of the cassette which he rented if he has returned any correct cassette or some other article. If the user has returned the correct cassette but the wrong way round then the supervisor will place the cassette in the machine the correct way round and reset it so that the user may again use the machine.

The arrangement has been described as being one in which the container is disabled only after the user has made two unsuccessful attempts to complete the transaction. This disablement could take place after any desired number of attempts to close the container with the cassette in the wrong way round or with a foreign article in the container.

A feature of the machine is that it is possible periodically to scan all the sensing means 55, 56 of all the containers. Thus a scan will show which containers are in their open state and which in their closed state and will also show which containers contain cassettes or if desired only the sensing means 56 may be scanned.

Means may therefore be provided to scan the sensors periodically and to compare the result of the scan with the transactions, i.e. rentals and returns, which are held in the memory 62.

If as a result of successive comparisons carried out by the comparator 63, it is found that containers apparently move from their closed state to their open state and/or cassettes are removed from containers without there being any corresponding transactions held in the memory appropriate action can be taken.

The changes may be due to component failure or may be due to vandalisation of the machine, i.e. somebody forcing open the containers and removing the cassettes.

Any desired routine of remedial action can be set in the control means. One such routine may be firstly to disable a container which has changed its state without there being any transaction affecting it on the supposition that there has been some component failure. The routine may similarly disable a second container which has changed its state. If a third container, however, changes its state without there being any transaction the routine could be such as to sound an alarm or, if the machine is connected to a remote terminal by way of a modem to dial up and give warning because it is likely that the machine is being vandalised.

We have described the use of reflective labels as the identifying elements of the articles and containers. However, labels which phosphoresce or otherwise are sensitized by an emitter could be used.

Other opto-electronic emitters and sensors may be used than those specifically described.

It will be seen that by the use of opto-electronic sensors and emitters one can provide a machine in which the sensing means provided by these are protected from defrauders as for example by the back plate 58 in the particular embodiment described and there are merely apertures in the back plate through which emitters and sensors emit and receive radiations.

I claim:

1. A vending machine for renting re-usable articles and comprising means for validating a user input to allow a user to operate the machine; a plurality of containers each adapted for receiving an article and each having a latched closed state in which an article in the container is not available to a machine user and an open state in which an article can be removed from or replaced in the container by the user, each container having associated therewith an opto-electronic sensor and a opto-electronic emitter, each container also having an identifying code and each article having an identifying code and an identifying element arranged to be presented to the emitter and the sensor when the article is in the container and the latter is in its closed state, the identifying element being so located on the article and being such that when subject to the output of the emitter it causes a signal to be generated by the sensor; control means having a rental mode and a return mode; user-operable input means to input a code; the control means being capable of being activated by the user when the control means is in rental mode to open a selected container and being capable of being activated by the inputting of an article code via the input means when the control means is in return mode to open an empty container to receive the article; and a memory associated with the control means and which holds the codes of empty containers and also the code of each article in the machine against the code of the container in which the article is held from time to time, the memory being updated every time an article is rented and returned; the control means being arranged to open an empty container when a valid artice code is inputted via the input means in the return mode of the control means and to permit the container to be returned to and remain latched in its closed state if the identifying element on an article placed therein is presented, when the container is closed, to the emitter and sensor associated with the container, the control means also being arranged to act to reopen the container if, after an empty container has been opened by the control means it is returned to its closed state and a cassette identifying element is not presented to the emitter and sensor of the container, means being provided to bring to the attention of the user that an article has not been correctly inserted into the container, and if, after a first reopening of the container by the control means, the user again closes the container a predetermined number of times without an article correctly inserted therein with its identifying element presented to the emitter and sensor of the container, the control means is arranged to act to (1) hold the container latched in its closed state, (2) invalidate any input by the user concerned to rent or return articles and (3) disable the container concerned from being opened by any other user, all until the control means is reset.

2. A machine according to claim 1 in which each container also has an identifying element and has associated therewith an opto-electronic sensor and an opto-electronic emitter, the identifying element being so located on the container and being such that, when the container is in its closed state, if the identifying element is subject to the output of the emitter a signal is generated by the sensor whereas if the container is in its open state no such signal is generated.

3. A machine according to claim 1 wherein each of at least some of the sensors and emitters operate in the infra-red part of the spectrum.

4. A machine according to claim 1 wherein a single flashing source is associated with a plurality of optical fibres, each optical fibre providing an emitter for a container.

5. A machine according to claim 4 wherein the flashing source emits ultra-violet radiation, the identifying label is phosphorescent, and the sensors are arranged to detect light from the identifying elements after the source has ceased emitting.

6. A machine according to claim 1 wherein each identifying element is in the form of a tamper-proof label which cannot be removed without destroying its capability of causing a signal to be generated by a sensor when subjected to the output of an emitter.

7. A machine according to claim 1 wherein the machine also comprises a screen positioned between each container and its associated opto-electronic sensor and opto-electronic emitter, the screen having at least one aperture therein arranged to allow radiation to pass from the emitter to the container and from the container to the sensor.

8. A machine according to claim 1 wherein each container has a pivot at a position adjacent a corner between its front face and a closed end thereof and pivots about said pivot between its open and closed states.

9. A machine according to claim 1 wherein the control means is operable in the rental mode to open an empty container provided that the code of the article entered by the user is that held in the memory against the user code.

10. A vending machine for renting re-usable articles and comprising means for validating a user input to allow a user to operate the machine; a plurality of containers each adapted for receiving an article and each having a latched closed state in which an article in the container is not available to a machine user and an open state in which an article can be removed from or replaced in the container by the user, each container having associated therewith an opto-electronic sensor and an opto-electronic emitter, each container also having an identifying code and each articles having an identifying code and an identifying element arranged to be presented to the emitter and the sensor when the article is in the container and the latter is in its closed state, the identifying element being so located on the article and being such that when subject to the output of the emitter it causes a signal to be generated by the sensor; control means having a rental mode and a return mode; user-operable input means to input a code; the control means being capable of being activated by the user when the control means is in rental mode to open a selected container and being capable of being activated by the inputting of an article code via the input means when the control means is in return mode to open an empty container to receive the article; and a memory associated with the control means and which holds the codes of empty containers and also the code of each article in the machine against the code of the container in which the article is held from time to time, the memory being updated every time an artticle is rented and returned; the control means being arranged to open an empty container when a valid article code is inputted via the input means in the return mode of the control means and to permit the container to be returned to and remain latched in its closed state if the identifying element on an article placed therein is presented, when the container is closed, to the emitter and sensor associated with the container, and a single flashing source is associated with a plurality of optical fibres, each optical fibre providing an emitter for a container.

11. A machine according to claim 10 wherein the flashing source emits ultra-violet radiation, the identifying label is phosphorescent, and the sensors are arranged to detect light from the identifying elements after the source has ceased emitting.

* * * * *